US011015514B2

(12) United States Patent
Na

(10) Patent No.: US 11,015,514 B2
(45) Date of Patent: May 25, 2021

(54) WATER PUMP FOR VEHICLE

(71) Applicants: Hyundai Motor Company, Seoul (KR); KIA Motors Corporation, Seoul (KR)

(72) Inventor: Jeong Hyun Na, Hwaseong-si (KR)

(73) Assignees: HYUNDAI MOTOR COMPANY, Seoul (KR); KIA MOTORS CORPORATION, Seoul (KR)

( * ) Notice: Subject to any disclaimer, the term of this patent is extended or adjusted under 35 U.S.C. 154(b) by 4 days.

(21) Appl. No.: 16/531,572

(22) Filed: Aug. 5, 2019

(65) Prior Publication Data

US 2020/0318527 A1 Oct. 8, 2020

(30) Foreign Application Priority Data

Apr. 2, 2019 (KR) ..... 10-2019-0038339

(51) Int. Cl.

| | |
|---|---|
| ***F01P 5/10*** | (2006.01) |
| ***F04D 1/00*** | (2006.01) |
| ***F01P 11/04*** | (2006.01) |
| ***F01P 3/02*** | (2006.01) |

(52) U.S. Cl.

CPC *F01P 5/10* (2013.01); *F01P 3/02* (2013.01); *F01P 11/04* (2013.01); *F04D 1/00* (2013.01)

(58) Field of Classification Search

CPC ..... F02D 1/00; F01P 3/02; F01P 11/04; F01P 5/10

See application file for complete search history.

(56) References Cited

U.S. PATENT DOCUMENTS 6,112,706 A * 9/2000 Heer ..... F01P 5/10 123/41.1
2013/0333863 A1* 12/2013 Pawellek ..... F04D 15/0038 165/104.19
2016/0258340 A1* 9/2016 Klippert ..... F04D 29/22

FOREIGN PATENT DOCUMENTS

JP 2003003848 A * 1/2003
KR 1998-049972 U 10/1998
KR 20030013598 A 2/2003

* cited by examiner

*Primary Examiner* — Kevin A Lathers
(74) *Attorney, Agent, or Firm* — Brinks Gilson & Lione

(57) ABSTRACT

A water pump for a vehicle includes a shaft for receiving rotational power from the engine; an impeller mounted on the shaft to pump the coolant discharged from the engine; and a housing where the shaft and the impeller are embedded, disposed in a direction opposite to the direction to which the shaft is connected with respect to the impeller to have a coolant inflow passage, into which the coolant discharged from the engine flows, formed therein, disposed along the edge of the impeller to have a coolant discharge passage for discharging the coolant pumped by the impeller to the heat exchanging means formed therein, and disposed in the direction to which the shaft is connected to have a bypass passage for discharging the coolant to the engine formed therein, and the housing has a connecting passage for connecting the coolant inflow passage and the bypass passage formed therein.

8 Claims, 5 Drawing Sheets

[FIG. 2]
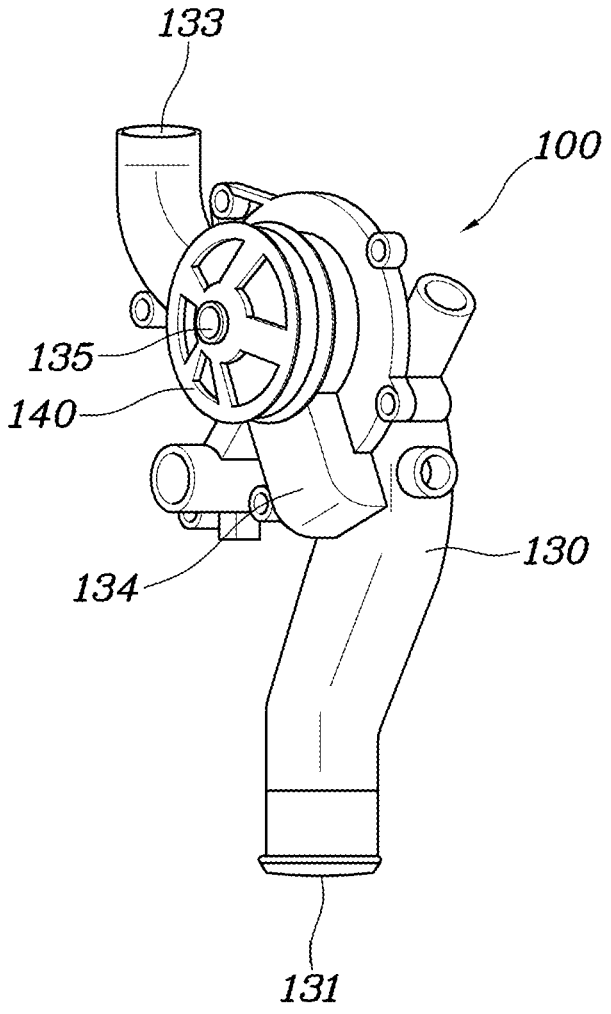

[FIG. 3]
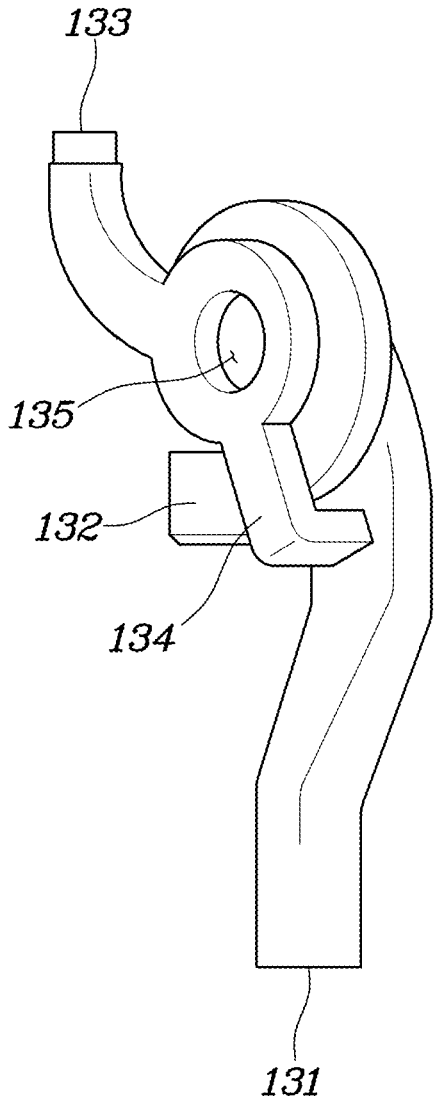

[FIG. 4]
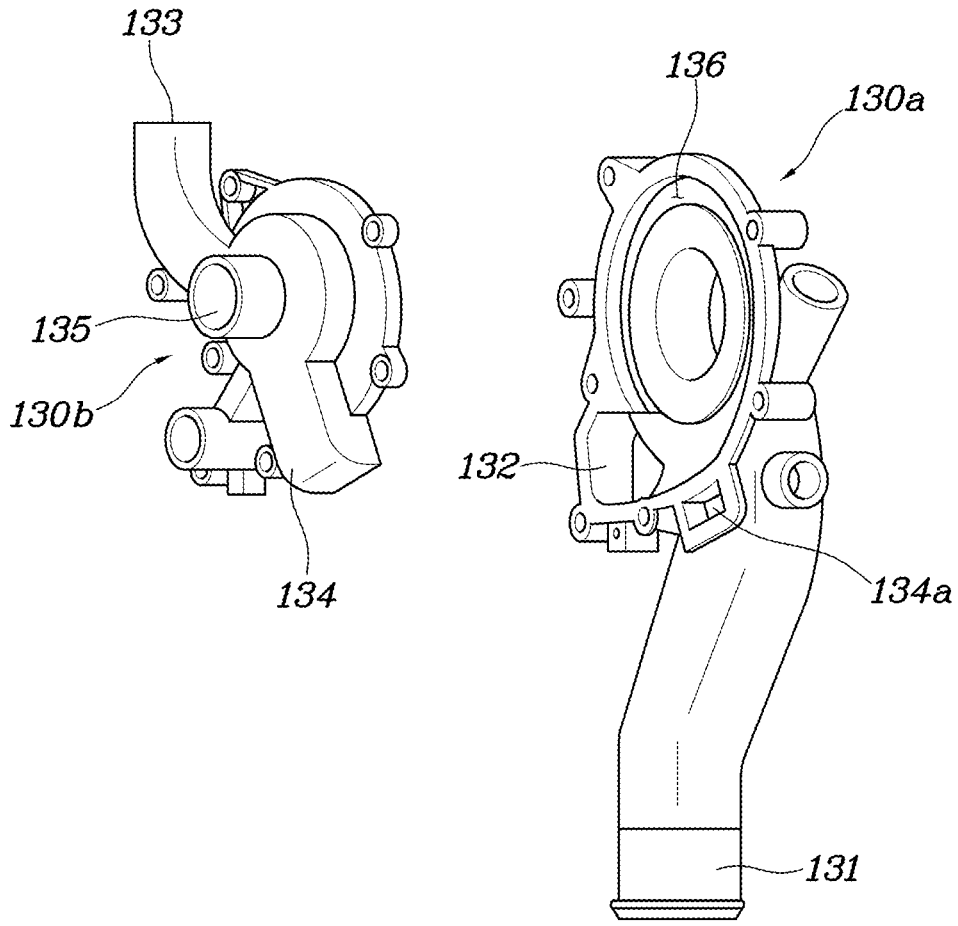

[FIG. 5]
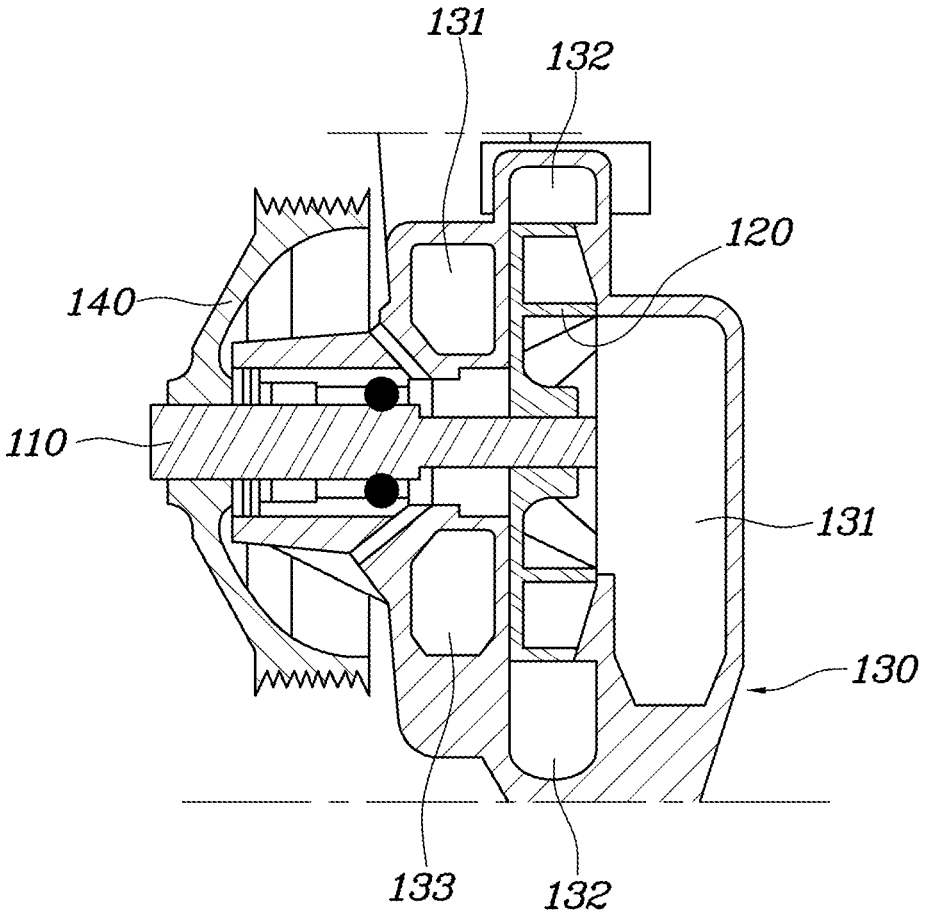

WATER PUMP FOR VEHICLE

CROSS REFERENCE TO RELATED APPLICATION

The present application claims priority to and the benefit of Korean Patent Application No. 10-2019-0038339, filed Apr. 2, 2019, which is incorporated herein by reference in its entirety.

FIELD

The present disclosure relates to a water pump for a vehicle.

BACKGROUND

The statements in this section merely provide background information related to the present disclosure and may not constitute prior art.

Generally, a water pump for a vehicle is used to forcibly feed and circulate coolant for cooling an engine.

Such a water pump is classified into an upper suction type and a lower suction type according to the inlet position into which the coolant flows.

The lower suction type water pump is a type of pump wherein a coolant inflow passage into which coolant flows from a cylinder block of the engine is formed at the lower side with respect to an impeller, and a coolant discharge passage is formed at the side portion or the upper side of the impeller.

Such a lower suction type water pump causes the coolant flowing into a housing from the lower coolant inflow passage to generate flow perpendicular to the impeller, and this flow is evenly distributed to a blade constituting the impeller, such that the impeller can supply an increased or maximum amount of energy to the received coolant.

On the other hand, the upper suction type water pump is a type of pump wherein the coolant inflow passage is formed at the upper side with respect to the impeller, and the coolant discharge passage is formed at the side portion or the lower side of the impeller. In such a device, a shaft for driving the impeller and a sealing structure may be present in the coolant inflow passage, where it may act to resist flow.

In general, available lower suction type water pumps have higher efficiency than upper suction type water pumps.

However, when the engine is a model to which the upper suction type water pump is applied, it has been difficult to apply by changing it into the lower suction type water pump.

The above information disclosed in this Background section is only for enhancement of understanding of the background of the present disclosure, and therefore it may contain information that does not form the prior art that is already known to a person of ordinary skill in the art.

SUMMARY

The present disclosure provides a lower suction type water pump for a vehicle, which includes a bypass passage while applying a lower suction type, thereby enhancing performance efficiency, and apply it to an engine to which an upper suction type water pump is applied; that is, an engine having a coolant inlet formed in an upper portion.

A water pump for a vehicle according to a form of the present disclosure includes, as the water pump for circulating coolant for cooling an engine of a vehicle between the engine and a heat exchanging means, a shaft for receiving rotational power from the engine; an impeller mounted on the shaft to pump the coolant discharged from the engine; and a housing in which the shaft and the impeller are embedded, disposed in a direction opposite to the direction to which the shaft is connected with respect to the impeller to have a coolant inflow passage, into which the coolant discharged from the engine flows, formed therein, disposed along the edge of the impeller to have a coolant discharge passage for discharging the coolant pumped by the impeller to the heat exchanging means formed therein, and disposed in the direction to which the shaft is connected to have a bypass passage for discharging the coolant to the engine formed therein, and the housing has a connecting passage for connecting the coolant inflow passage and the bypass passage formed therein.

The housing is composed of a case having the coolant inflow passage formed therein, having a receiving space in which the impeller is embedded while being communicated with the coolant inflow passage formed therein, and having the coolant discharge passage communicated with the receiving space formed therein; and a cover formed to close the receiving space, having the connecting passage communicated with the coolant inflow passage formed therein, and having the bypass passage for connecting the connecting passage to the engine formed therein.

The cover has an installation hole installed by penetrating the shaft formed therein, and the bypass passage is formed in an annular shape along the edge of the installation hole, has one end communicated to the connecting passage, and has the other end connected to the engine.

A belt pulley for converting the power transferred from the engine into the power for rotating the shaft is installed on the outer circumferential surface of the installation hole, and the belt pulley and the shaft are directly connected.

The bypass passage is not interfered with the belt pulley.

A thermostat is connected to the other end of the bypass passage.

The water pump is a lower suction type water pump.

The water pump is installed on a coolant circulating line of the engine to which an upper suction type water pump is applied.

According to a form of the present disclosure, it is possible to improve the path of the bypass passage while applying the lower suction type, thereby enhancing the efficiency of the water pump as compared to the upper suction type and expecting the enhancement of fuel efficiency of the vehicle.

In addition, it is possible to apply the lower suction type water pump according to the present disclosure to the engine to which the upper suction type water pump is applied without changing the structure of other parts.

Further areas of applicability will become apparent from the description provided herein. It should be understood that the description and specific examples are intended for purposes of illustration only and are not intended to limit the scope of the present disclosure.

DRAWINGS

In order that the disclosure may be well understood, there will now be described various forms thereof, given by way of example, reference being made to the accompanying drawings in which:

FIG. 2 is a perspective diagram illustrating the water pump for the vehicle according to a form of the present disclosure.

FIG. 3 is a major part perspective diagram illustrating a major part of the water pump for the vehicle according to a form of the present disclosure.

FIG. 4 is a coupling diagram illustrating the water pump for the vehicle according to a form of the present disclosure.

FIG. 5 is a major part cross-sectional diagram illustrating the major part of the water pump for the vehicle according to a form of the present disclosure.

Figure 1:
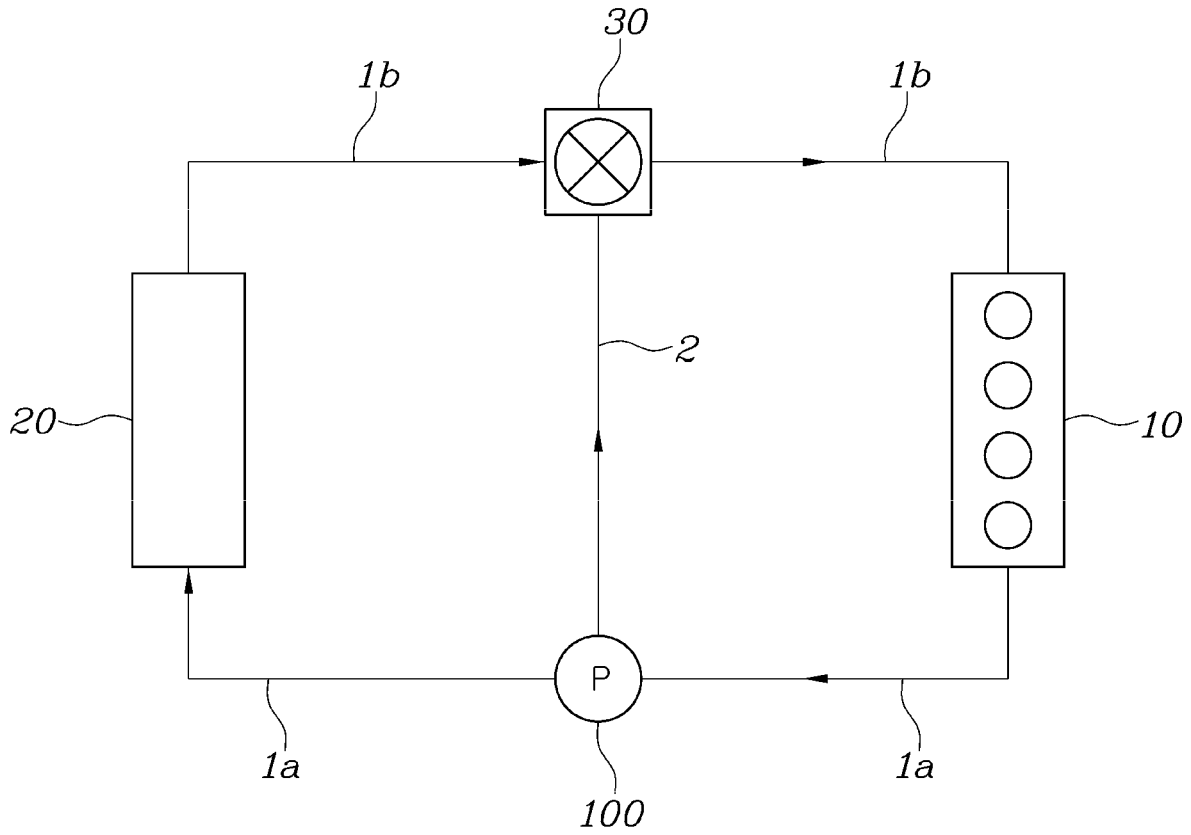
FIG. 1 is a diagram illustrating a cooling system of an engine to which a water pump for a vehicle according to a form of the present disclosure is applied.

The drawings described herein are for illustration purposes only and are not intended to limit the scope of the present disclosure in any way.

DETAILED DESCRIPTION

The following description is merely exemplary in nature and is not intended to limit the present disclosure, application, or uses. It should be understood that throughout the drawings, corresponding reference numerals indicate like or corresponding parts and features.

Hereinafter, forms of the present disclosure will be described in more detail with reference to the accompanying drawings. However, the present disclosure is not limited to the forms disclosed below but can be implemented in various forms differently from each other and rather, these forms are provided so that the present disclosure will be thorough and complete and to completely convey the scope of the disclosure to those skilled in the art. The same reference numerals refer to the same elements in the drawings.

FIG. 1 is a diagram illustrating a cooling system of an engine to which a water pump for a vehicle according to a form of the present disclosure is applied.

As in FIG. 1, a water pump for a vehicle 100 according to a form of the present disclosure is a means for flowing the coolant circulated between an engine 10 and a heat exchanging means 20. At this time, a radiator provided in the vehicle can be applied as the heat exchanging means 20.

At this time, a path through which the coolant flows between the engine 10 and the heat exchanging means 20 is divided into circulating lines 1*a*, 1*b* for circulating the coolant between the engine 10 and the heat exchanging means 20, and a bypass line 2 for flowing the coolant discharged from the engine 10 into an engine as it is without circulating it to the heat exchanging means 20.

Therefore, the water pump for the vehicle 100 according to the present disclosure is disposed on the circulating line 1*a* for flowing the coolant discharged from the engine 10 into the heat exchanging means 20, and the water pump 100 is connected to the circulating line 1*b* branched from the bypass line 2 to flow the coolant discharged from the heat exchanging means 20 into the engine 10.

Meanwhile, a thermostat 30 for measuring the temperature of the coolant to provide it to an Electronic Control Unit (ECU) for the vehicle so that the ECU can control the path in which the coolant flows is connected to the rear end of the water pump 100.

Next, a configuration of the water pump will be specifically described.

FIG. 2 is a perspective diagram illustrating the water pump for the vehicle according to a form of the present disclosure, FIG. 3 is a major part perspective diagram illustrating a major part of the water pump for the vehicle according to a form of the present disclosure, FIG. 4 is a coupling diagram illustrating the water pump for the vehicle according to a form of the present disclosure, and FIG. 5 is a major part cross-sectional diagram illustrating the major part of the water pump for the vehicle according to a form of the present disclosure.

As illustrated in the drawings, the water pump for the vehicle 100 according to a form of the present disclosure is a water pump for improving a bypass passage of the water pump to which a lower suction type is applied for application to an engine to which an upper suction type water pump is applied.

That is, the water pump for the vehicle 100 according to a form of the present disclosure includes a shaft 110 for receiving rotational power from the engine 10; an impeller 120 mounted on the shaft 110 to pump the coolant discharged from the engine 10; and a housing 130 in which the shaft 110 and the impeller 120 are embedded and having a coolant inflow passage 131, a coolant discharge passage 132, and a bypass passage 133 formed therein. Particularly, the housing 130 has a connecting passage 134 for connecting the coolant inflow passage 131 and the bypass passage 133 formed therein.

The shaft 110 is provided to be rotated by a belt pulley 140 for receiving the driving force of the engine 10 through a belt in order to be rotated by interlocking with an operation of the engine 10.

The impeller 120 is installed at the end portion of the shaft 110 to be rotated integrally by the rotation of the shaft 110 to generate a force for flowing the coolant.

The shaft 110 and the impeller 120 have a configuration to be applied to a general water pump, and the specific configuration thereof can be modified and implemented in various structures and forms.

The housing 130 is a means in which the shaft 110 and the impeller 120 are embedded and having the coolant inflow passage 131, the coolant discharge passage 132, and the bypass passage 133 formed therein, and the arrangement of the coolant inflow passage 131 and the coolant discharge passage 132 is disposed in a lower suction type.

For example, the coolant inflow passage 131 is disposed in the direction opposite to the direction to which the shaft is connected with respect to the impeller 120 to be connected to the circulating line 1*a* so that the coolant discharged from the engine 10 flows into.

The coolant discharge passage 132 is disposed along the edge of the impeller 120 to discharge the coolant pumped by the impeller 120 to the outside of the housing 130 and connected to the circulating line 1*a* connected to the heat exchanging means 20.

The bypass passage 133 is disposed in the direction to which the shaft 110 is connected and connected to the bypass line 2 so that the coolant flowing into the coolant inflow passage 131 is discharged to the bypass line 2.

Particularly, the housing 130 has the connecting passage 134 for connecting the coolant inflow passage 131 and the bypass passage 133 formed therein.

At this time, the connecting passage 134 communicates the coolant inflow passage 131 with the bypass passage 133 by bypassing the region where the shaft 110 and the impeller 120 have been embedded so that the shaft 110 and the impeller 120 do not act as a resistor because the coolant flowing into the coolant inflow passage 131 does not pass through the region where the shaft 110 and the impeller 120 are disposed.

Meanwhile, the housing 130 is configured by assembling a case 130*a* and a cover 130*b*.

The case 130*a* has the coolant inflow passage 131 formed therein, has a receiving space 136 in which the impeller 120 is embedded while being communicated with the coolant inflow passage 131 formed therein, and has the coolant discharge passage 132 communicated with the receiving space 136 formed therein.

At this time, the case 130*a* has a connecting passage hole 134*a* for communicating the coolant inflow passage 131 to the connecting passage 134 formed therein.

Then, the cover 130*b* is formed to close the receiving space 136, has the connecting passage 134 communicated with the coolant inflow passage 131 formed therein, and has the bypass passage 133 for connecting the connecting passage 134 to the bypass line 2 formed therein. Therefore, the connecting passage 134 is connected with the coolant inflow passage 131 while being communicated with the connecting passage hole 134*a* formed in the case 130*a*.

Meanwhile, in order to install the shaft 110 in the housing 130, an installation hole 135 installed by penetrating the shaft 110 is formed in the cover 130*b*. Therefore, the shaft 110 is installed to penetrate the installation hole 135 to have one side extended to the outside of the housing 130 and have the other side extended to the receiving space 136 inside the housing 130. Therefore, the belt pulley 140 is installed at one side of the shaft 110, and the impeller 120 is installed at the other side thereof.

At this time, the bypass passage 133 is formed in an annular shape along the edge of the installation hole 135 in order to bypass the region where the shaft 110 and the impeller 120 have been installed, and has one end communicated with the connecting passage 134, and has the other end connected to the bypass line 2 connected to the engine 10. Then, the thermostat 30 is connected to the other end of the bypass passage 133 to measure the temperature of the coolant.

Meanwhile, as the belt pulley 140 is installed on the outer circumferential surface of the installation hole 135, the region protruded from the cover 130*b* of the housing 130 for forming the installation hole 135 acts as the rotatable rotary shaft by the belt pulley 140. At this time, one side end portion of the shaft 110 is exposed to the outside of the installation hole 135 to be directly connected with the belt pulley 140.

Then, the bypass passage 133 is formed in an annular shape along the edge of the installation hole 135 on the circumference of the region protruded from the cover 130*b* of the housing 130 for forming the installation hole 135, and at this time, as the outer surface of the region where the bypass passage 133 has been formed is formed to be flat, the belt pulley 140 is not interfered therewith during rotation.

While the present disclosure has been described in connection with what is presently considered to be practical exemplary forms, it is to be understood that the present disclosure is not limited to the disclosed forms, but, on the contrary, it is intended to cover various modifications and equivalent arrangement included within the spirit and scope of the present disclosure.

What is claimed is:

1. A water pump for circulating coolant for cooling an engine of a vehicle, the water pump comprising:

a shaft for receiving rotational power from the engine;

an impeller mounted on the shaft to pump the coolant discharged from the engine; and a housing including:

a cover formed with an installation hole and a bypass passage, and a case formed with a coolant inflow passage and a coolant discharge passage, wherein:

the cover and the case are disposed in opposite directions to each other and form the housing together, the shaft is inserted through the installation hole formed in the cover, and the impeller is accommodated in the case, the coolant inflow passage is configured to introduce a coolant discharged from the engine into the housing, the coolant discharge passage is disposed along an edge of the impeller and configured to discharge the coolant pumped by the impeller to a heat exchanging means, the bypass passage is disposed around the installation hole and configured to discharge the coolant introduced from the coolant inflow passage to the engine, and the housing has a connecting passage for connecting the coolant inflow passage and the bypass passage.

2. The water pump according to claim 1, wherein the case has a receiving space in which the impeller is accommodated and configured to fluidly communicate with the coolant inflow passage, and the coolant discharge passage; and the cover is configured to close the receiving space and formed with the connecting passage configured to fluidly communicate with the coolant inflow passage.

3. The water pump according to claim 2, wherein the bypass passage is formed in an annular shape along an edge of the installation hole, includes: a first one end in communication with the connecting passage, and a second end connected to the engine.

4. The water pump according to claim 3, wherein a belt pulley for converting power transferred from the engine into power for rotating the shaft is installed on an outer circumferential surface of the installation hole, and the belt pulley and the shaft are directly connected.

5. The water pump according to claim 4, wherein the bypass passage is formed with a flat portion on an outer surface of the cover, such that the bypass passage is configured to not interfere with the belt pulley as the belt pulley rotates.

6. The water pump according to claim 1, wherein a thermostat is connected to an end of the bypass passage.

7. The water pump according to claim 1, wherein the water pump is a lower suction type water pump.

8. The water pump according to claim 1, wherein the water pump is installed on a coolant circulating line of the engine, wherein the engine includes a coolant inlet formed in an upper portion thereof.

* * * * *